US006148606A

United States Patent [19]

Grossi et al.

[11] Patent Number: 6,148,606

[45] Date of Patent: Nov. 21, 2000

[54] LOW-VULNERABILITY SOLID-PROPELLANT MOTOR

[75] Inventors: Augustin Grossi, Montesson; Patrick Fiandesio, Triel sur Seine, both of France

[73] Assignee: Celerg, Le Plessis Robinson Cedex, France

[21] Appl. No.: 09/096,613

[22] Filed: Jun. 12, 1998

[30] Foreign Application Priority Data

Jun. 16, 1997 [FR] France ..... 97 07429

[51] Int. Cl.[7] ..... F02K 9/38

[52] U.S. Cl. ..... 60/223; 60/255

[58] Field of Search ..... 60/223, 253, 254, 60/255

[56] References Cited

U.S. PATENT DOCUMENTS

| | | | |
|---|---|---|---|
| 2,987,882 | 6/1961 | Nocke | 60/255 |
| 3,052,091 | 9/1962 | D'Ooge . | |
| 3,177,655 | 4/1965 | White | 60/253 |
| 3,889,463 | 6/1975 | San Miguel | 60/255 |
| 5,032,201 | 7/1991 | Crapiz | 156/172 |
| 5,166,468 | 11/1992 | Atkeson . | |

FOREIGN PATENT DOCUMENTS

| | | |
|---|---|---|
| 0559436 | 9/1993 | European Pat. Off. . |
| 2627272 | 8/1989 | France . |
| 9604474 | 2/1996 | WIPO . |

*Primary Examiner*—Louis J. Casaregola
*Attorney, Agent, or Firm*—Pillsbury Madison & Sutro LLP

[57] ABSTRACT

The present invention relates to a low-vulnerability solid-propellant motor (1) comprising a charge (11) of solid propellant, a heat shield (2) covering the inside of a metal structure with a front end wall (3) and a rear end wall (4) which carries at least one nozzle (10), the said front and rear end walls being fastened to a cylindrical shell (5) having wide apertures which are circumferentially distributed and temporarily sealed by sealing plugs (8). The object of the present invention is to provide a motor which has a simple structure and avoids the use of detection and actuation means for freeing the plugs. The motor according to the invention is such that the sealing plugs (8) are held in the apertures between the heat shield and a composite winding (7) of fibres impregnated in a matrix which surrounds the cylindrical shell (5).

13 Claims, 2 Drawing Sheets

LOW-VULNERABILITY SOLID-PROPELLANT MOTOR

The present invention relates to the field of insensitive munitions. More particularly, the present invention relates to a solid-propellant motor with a low vulnerability to certain forms of external attack, such as a fire in an ammunition dump or the impact of fragments or of bullets on the munition. When under attack, for example in a fire in an ammunition dump, the charge of solid propellant of a motor in a metal structure will ignite after it has been heated for a certain length of time. The metal of the structure, despite being heated, still has significant strength but the pressure inside the motor will therefore increase, either causing it to explode or to move adventitiously due to the thrust of the gases expelled via the nozzle. This increases the damage resulting from the fire in the dump and in its environment.

Devices are known for rapidly depressurizing or for stopping the thrust of solid-propellant motors by liberating or cutting away sealed apertures located in the structure, generally by pyrotechnic means. Patent U.S. Pat. No. 3,052,091 describes a device having sealing plugs which seal apertures in the structure and are held in place by two half-shells fastened together by explosive bolts. When the explosive bolts are triggered, the half-shells separate and the plugs are pushed out by the internal pressure in the motor and free the apertures the pressure rapidly drops and the thrust is stopped. Patent U.S. Pat. No. 5,166,468 describes the application of this technique for reducing the vulnerability of a solid-propellant motor. A set of thermocouples suitably located in the structure of the motor and combined with an electronic microcircuit detects heat-up of the structure by a fire and triggers the operation of the pyrotechnic device, thereby freeing the apertures. This technique has as first drawback that of requiring detection and actuation means which are quite bulky and complicated, and therefore subject to failure. In addition, the operation is accompanied by plugs and holding devices, which are usually made of metal, being projected.

Moreover, motors are known which have a compound structure having an internal structure reinforced by an external winding of fibres impregnated in a resin or, more generally, in a matrix. Patent FR 2,606,082 describes a compound structure, the internal structure of which comprises two tube sectors made by cutting a tube longitudinally and by a circumferential overwinding which withstands the internal pressure during the operation—we should point out that this motor also has two long longitudinal slots. The internal structure withstands the longitudinal forces. Patent Application EP 0,559,436, specified by Patent Application WO 96/04474, describes a compound structure for reducing the vulnerability of solid-propellant motors which has, in particular, a metal shell with a multitude of very narrow slots and a composite external winding of fibres impregnated in a resin. When this structure is caught in a fire, the composite winding heats up and is quite rapidly destroyed. Furthermore, when after being heated up the solid propellant of the charge catches fire, the metal structure, which can only withstand axial forces, deforms and allows the combustion gases to escape via the slots, preventing any significant increase in the pressure in the motor. However, this device has the drawback of requiring a lengthy and tricky operation to machine many slots and runs the risk of tearing of the metal structure.

The object of the present invention is to provide a device which does not have the above drawbacks.

The present invention relates to a low-vulnerability solid-propellant motor, comprising a charge of solid propellant, a heat shield covering the inside of a metal structure with a front end wall and a rear end wall which carries at least one nozzle, the said front and rear end walls being fastened to a cylindrical shell having wide apertures which are circumferentially distributed and temporarily sealed by sealing plugs; the motor is such that the sealing plugs are held in the apertures between the heat shield and a composite winding of fibres impregnated in a matrix which surrounds the cylindrical shell, the said plugs being freed by accidental degradation of the composite winding.

External attack degrades, or even destroys, the composite winding, the sealing plugs no longer being retained by the winding, are forced out by the internal gases which then escape via the wide apertures, preventing any significant increase in the pressure in the motor. Optionally, the apertures are uniformly distributed around the circumference in order to balance the forces due to the gases flowing through each of the apertures. There are therefore at least two diametrically opposed apertures in the cylindrical shell; however, if there are more apertures, these may be distributed in several transverse groups along the cylindrical shell, it being understood that in each transverse group the apertures are, optionally, uniformly distributed around the circumference.

Advantageously, each sealing plug is such that its external face has the same radius of curvature as that of the external face of the cylindrical shell. This condition avoids flats or excrescences which might damage the composite winding. Likewise, the internal face of each sealing plug has the same radius of curvature as that of the internal part of the cylindrical shell.

Also advantageously, each sealing plug is made of a material of the heat-shield material type. It may be the same material as that of the heat shield of the motor, but it is also possible to use a different material. The heat-shield material must be compatible with the solid propellant making up the charge. Heat-shield materials are generally elastomers of the polymer or rubber type, containing various fillers and, in particular, pulverulent and/or fibrous fillers for improving the thermal withstand capability.

Preferably, each sealing plug is a region of additional thickness of the heat shield which fills the volume of the aperture—the plug forms part of the heat shield. The sealing action of the plug is provided by the contact between its peripheral part and the edge of the aperture and it is enhanced by being integrated with the heat shield.

Advantageously, that portion of the cylindrical shell where the apertures are made is thinner and the composite winding reinforces the integrity of the structure. Thinner portion should be understood to mean that, over this portion of the cylindrical shell, which may represent almost the entire length of the shell, the thickness of the shell is just that necessary to with-stand the axial or longitudinal forces. The radial forces, especially those due to the operating pressure, are withstood by the composite winding which thus reinforces the cylindrical shell.

Advantageously, the flow area of the set of apertures is at least equal to ten times the area of the throat of the nozzle. Of course, if the motor has several nozzles, the condition is calculated with respect to the sum of the areas of the throats of the nozzles.

The apertures may have any geometrical shape. Optionally, these apertures have an oblong shape along the direction of the axis of the motor, examples of such oblong shapes being described below.

Advantageously, each aperture, when it is oblong, has a major axis parallel to the axis of the cylindrical shell and its greatest width is greater than or equal to one fifteenth of the diameter of the cylindrical shell. For example, the oblong aperture has an oval or elliptical shape. The purpose of this condition on the width of the oblong aperture is to avoid crack propagation—a risk associated with apertures which are too narrow, such as slots.

Each oblong aperture has a rectangular part of length L terminated by two identical opposite parts, the shape of which avoids crack propagation. Advantageously, these opposite parts have the shape, for example, of a basket handle, of a semi-ellipse or, more simply, of a semicircle.

The length L of the rectangular part of each oblong aperture is less than or equal to half the length of the thinner portion of the cylindrical shell.

Preferably, the motor has at most three transverse groups of apertures distributed along the cylindrical shell. There are at most eight circumferentially distributed apertures in each transverse group. Preferably, the number of apertures in each transverse group is between 2 and 4.

Finally, the axial distance L' separating two successive transverse groups on the cylindrical shell is greater than or equal to half the length L, i.e. the length of the rectangular part of an oblong aperture.

The motor according to the invention has the advantages of not requiring detection and actuation devices for freeing the apertures, of not projecting pieces of metal, or at the very most projecting a few pieces of the heat shield, and, finally, of the fact that the cylindrical shell has a limited number of apertures which are easy to machine and do not run the risk of crack propagation.

The present invention is explained in greater detail by means of the following figures which illustrate one particular embodiment.

Figure 1:
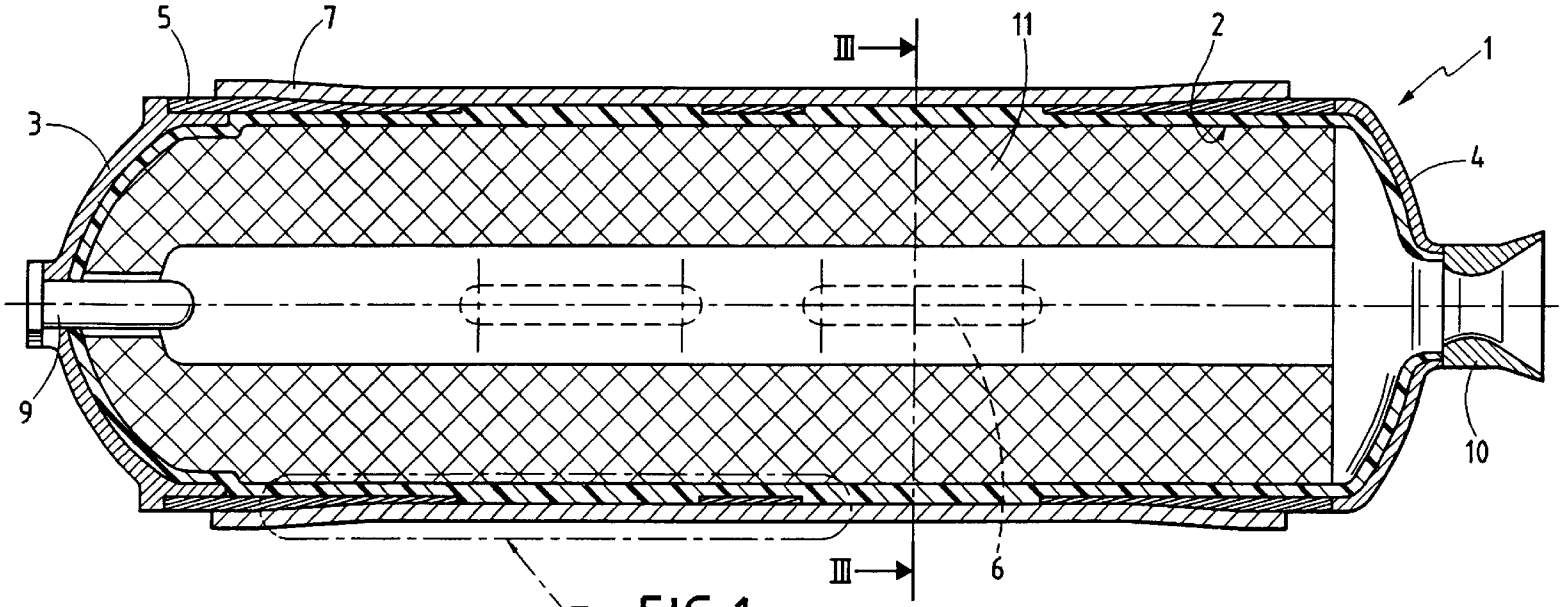
FIG. 1 is a longitudinal sectional view of a motor according to the invention.

FIG. 1 illustrates, in longitudinal section, a motor 1 which has a metal structure whose internal part is covered with a heat shield 2. This metal structure consists, in particular, of a front end wall 3 and a rear end wall 4 which are fastened to a cylindrical shell 5 which has several oblong apertures 6 sealed by sealing plugs 8, the shell 5 being externally reinforced by a circumferential winding 7 of fibres impregnated in a matrix. An igniter device 9 is fixed to the front end wall 3. A nozzle 10 is fixed to the rear end wall 4. The solid-propellant charge, illustrated by 11, is of the free-charge type. In this example, each sealing plug 8 is in fact a region of additional thickness of the heat shield which occupies the entire internal volume of each oblong aperture 6. In this example, the shape of the oblong apertures is very simple—it has a part with parallel edges of length L which are 2R apart or, in other words, a rectangular part of length L and of width 2R, which is terminated at its two ends by semicircles of radius R.

Figure 2:
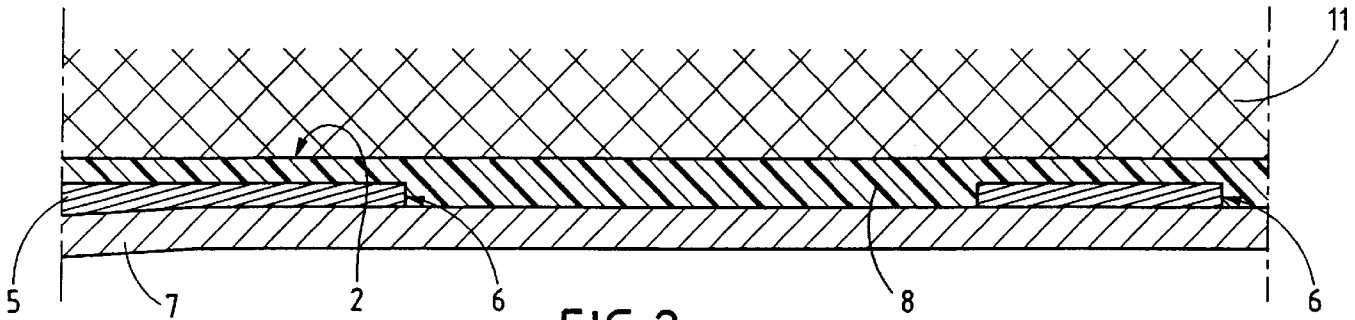
FIG. 2 is an enlargement of the detail II shown in the previous figure.

FIG. 2 is an enlargement of the detail II shown in FIG. 1. Again, the cylindrical shell is denoted by 5, and this figure shows the connection between the thinner part, which includes the oblong apertures 6, and the thicker, end part for connection with the end walls. The external composite winding 7 covers the thinner part of the shell 5 and, in particular, the plugs 8 for the oblong apertures 6. This winding extends over the thick part of the cylindrical shell and terminates thereon. The heat shield 2 covers the inside of the metal structure and has regions of additional thickness which fill the entire volume of an oblong aperture as far as the external composite winding; these regions of additional thickness of the heat shield act as sealing plugs 8.

Figure 3:
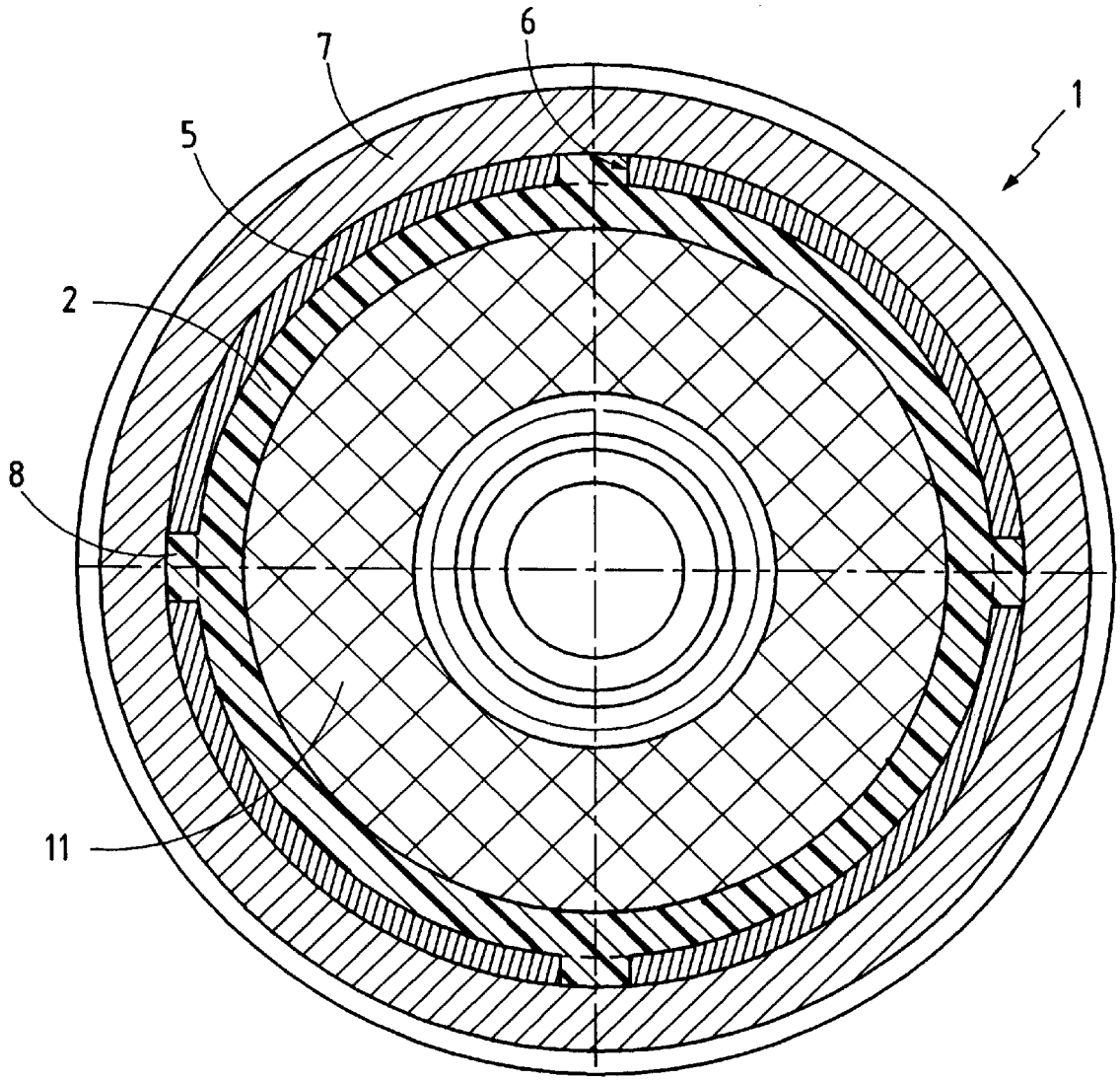
FIG. 3 is a cross-sectional view on III of the motor in line with a group of apertures which, in this example, are oblong.

FIG. 3 illustrates a diagrammatic cross-section of the compound structure at a group of oblong apertures. The metal shell 5 has, for this group, four oblong apertures 6 which are uniformly distributed, i.e. in the present case at 90° with one another. The internal part of the cylindrical shell 5 is lined with a heat shield 2 which, at the oblong apertures 6, has regions 8 of additional thickness which engage in the oblong apertures 6. It may be seen in this figure that the external face of these regions of additional thickness is profiled so as to have a radius of curvature equal to that of the external part of the cylindrical shell—this arrangement re-establishes the circularity of the structure and avoids regions consisting of flats corresponding to part of the oblong apertures.

In this example, the shell has two transverse groups of oblong apertures, each group having four oblong apertures angularly separated by 90°. The oblong apertures therefore have a simple shape—a rectangular part of length L=57.5 mm and of width 2R=10 mm, terminated by two semicircular portions of radius R. The oblong apertures are machined by simple mechanical means—in the present case by milling, for example; the only desirable precaution is to ensure that the edges of the apertures are clean and sharp.

The oblong apertures of the two groups are, here, aligned and separated by a distance L'=30 mm. Knowing that the length Laf of the thinner part of the cylindrical shell is 230 mm, that its external diameter D is 140 mm and that the diameter of the throat of the nozzle is 12 mm, the reader may confirm that all the conditions mentioned above are fulfilled.

When the motor of the present invention is caught in a fire, the heat of the fire destroys, or seriously degrades, the composite winding so that this winding no longer has any mechanical strength, or has only a very low strength. When, in turn, the solid propellant of the charge ignites by being heated up, the combustion gases pressurize, very slightly, the combustion chamber and the gap between the charge and the heat shield. This very slight pressurization is sufficient to puncture the heat shield at the oblong apertures, as this part, which forms a plug, is no longer held in place by the remains of the winding, or is very weakly held thereby. The apertures are freed and the gases escape, avoiding any increase in pressure. These wide apertures are favourable as the resultant of the pressure forces on the surface of the plug increases as the area of the aperture, while the shear strength, to be overcome, increases only as the perimeter of the aperture. Finally, the only things projected are the plugs made of heat-shield material, and therefore quite flexible, and in all cases non-metallic, materials.

The metallic structure is produced from any metal normally used in this field; mention may preferably be made of high-strength light alloys and steels. The front end wall 3 and the rear end wall 4 are fastened to the cylindrical shell 5 using standard ways of fixing such as a clip, screwing or welding. In this example, the cylindrical shell has a small thickness over practically its entire length, only the ends where the connections to the end walls are made having a additional thickness. The thinner part of this cylindrical shell may optionally extend over a more limited region of the shell; in the oblong apertures will be made this portion. The shell also has devices for attaching the wing of the missile or other components which have to be fixed to the structure, this being accomplished by standard techniques since they are metallic components. The front and rear end walls also have bases, in order to fix thereto the igniter and the nozzle or nozzles, as well as skirts for connecting the motor to the other parts of the missile. The fixing components are not. illustrated or detailed in this figure.

The outside of the cylindrical shell, more particularly its entire thinner portion, is covered by a circumferential winding of fibres impregnated in a matrix, the composite winding being designed to withstand the radial forces during the rated operation of the motor—it will be recalled that the metallic cylindrical shell withstands the axial forces. The materials of the composite winding, or at least the matrix which impregnates the fibres, are chosen so as to degrade or to lose their mechanical properties above a temperature greater than the maximum temperature reached during the rated use of the motor but less than the temperature at which the solid propellant ignites when heated. Organic materials such as, for example, aramid fibres such as those sold under the name KEVLAR®, or carbon fibres and, in the case of the matrix, an epoxy resin for example, are suitable for this application.

The internal part of the metal structure is, in a known way, covered with a heat shield manufactured from a heat-shield material compatible with the solid propellant of the charge. This heat shield is designed depending on the missile's mission. This heat shield is fitted by casting, drape forming or any other technique appropriate to the nature of the material adopted. For example, the heat-shield material is an elastomer obtained by crosslinking a polybutydiene which has hydroxytelechelic end groups and is filled with refractory materials ($SiO_2$, etc.) in powder and fibre form.

The charge of solid propellant may be of the type which is free or is cast and bonded, it may include one or more frontal-combustion or radial-combustion blocks of solid propellant, and the appropriate provisions inhibitor, bonding and/or fastening—are known to those skilled in the art.

Any type of propellant may be suitable for producing the charge, but propellant not giving rise to combustion/detonation transition phenomena during the kinds of attack envisaged here are preferred.

In this example, the charge consists of a block of solid propellant having a central channel, hence a radial-combustion block. This block is mounted so as to be free in the structure, this type of mounting leaving a gap between the heat shield of the structure and the block's external surface coated with an inhibitor. This gap is maintained by appropriate fastening devices, the details of which are not given here.

What is claimed is:

1. Low-vulnerability solid-propellant motor (1) comprising a charge (11) of solid propellant, a heat shield (2) covering the inside of a metal structure with a front end wall (3) and a rear end wall (4) which carries at least one nozzle (10), the said front and rear end walls being fastened to a cylindrical shell (5) having wide apertures (6) which are circumferentially distributed and temporarily sealed by sealing plugs, which motor is characterized in that the sealing plugs (8) are held in the apertures (6) between the heat shield and a composite winding (7) of fibres impregnated in a matrix which surrounds the cylindrical shell (5), the said plugs (8) being freed by accidental degradation of the composite winding (7).

2. Motor (1) according to claim 1, characterized in that each sealing plug (8) is such that its external face has the same radius of curvature as that of the external face of the cylindrical shell (5).

3. Motor (1) according to claim 1 or 2, characterized in that each sealing plug (8) is made of a material of the heat-shield material type.

4. Motor (1) according to claim 3, characterized in that each sealing plug (8) is a region of additional thickness of the heat shield (2).

5. Motor (1) according to claim 1, characterized in that that portion of the cylindrical shell (5) where the apertures (6) are made is thinner and in that the composite winding (7) reinforces the cylindrical shell (5).

6. Motor (1) according to claim 5, characterized in that the flow area of the set of apertures (6) is at least equal to ten times the area of the throat of the nozzle (10).

7. Motor (1) according to claim 6, characterized in that each oblong aperture has a major axis parallel to the axis of the cylindrical shell (5) and its greatest width is greater than or equal to one fifteenth of the diameter of the cylindrical shell (5).

8. Motor (1) according to claim 6 or 7, characterized in that each oblong aperture (6) has a rectangular part of length L terminated by two identical opposite portions, the shape of which avoids crack propagation.

9. Motor (1) according to claim 8, characterized in that the length L of the rectangular part of each oblong aperture is less than or equal to half the length of the thinner portion of the cylindrical shell (5).

10. Motor (1) according to claim 6, characterized in that it has at most three transverse groups of apertures (6) distributed along the cylindrical shell (5).

11. Motor (1) according to claim 10, characterized in that each transverse group of apertures has at most eight apertures.

12. Motor (1) according to claim 11, characterized in that the preferred number of apertures in each transverse group is between 2 and 4.

13. Motor (1) according to claim 8, characterized in that the axial distance L' separating two successive transverse groups on the cylindrical shell (5) is greater than or equal to half the length L, i.e. the length of the rectangular part of an oblong aperture.

* * * * *